United States Patent [19]

Tolle et al.

[11] Patent Number: 4,848,982

[45] Date of Patent: Jul. 18, 1989

[54] ARRANGEMENT FOR COOLING A SYNTHETIC GAS IN A QUENCHING COOLER

[75] Inventors: Arnold Tolle, Mönchengladbach; Manfred Förster, Essen; Heinz Haacker, Kreuztal-Ferndo; Helmut Wensing, Essen, all of Fed. Rep. of Germany

[73] Assignees: Deutsche Babcock Werke AG; Man Gutehoffnungshütte GmbH, both of Oberhausen, Fed. Rep. of Germany

[21] Appl. No.: 177,531

[22] Filed: Apr. 4, 1988

[30] Foreign Application Priority Data

Apr. 3, 1987 [DE] Fed. Rep. of Germany ..... 3711314

[51] Int. Cl.[4] ..... C10J 3/72

[52] U.S. Cl. ..... 48/69; 48/DIG. 2; 55/269; 239/132.3; 165/47

[58] Field of Search ..... 48/69, 77, 67, DIG. 2; 55/93, 94, 80, 223, 269; 239/132.3; 122/5, 6 A, 7 R; 110/171; 261/140.1; 165/111, 47

[56] References Cited

U.S. PATENT DOCUMENTS

| | | | |
|---|---|---|---|
| 3,223,398 | 12/1965 | Bertram et al. | 239/132.3 |
| 4,377,132 | 3/1983 | Koog et al. | 48/69 |
| 4,457,764 | 7/1984 | Dorling et al. | 48/DIG. 2 |
| 4,487,611 | 12/1984 | Ziegler | 48/69 |
| 4,509,463 | 4/1985 | Volhardt et al. | 48/67 |

FOREIGN PATENT DOCUMENTS 2940933 12/1985 Fed. Rep. of Germany .

*Primary Examiner*—Noah P. Kamen
*Attorney, Agent, or Firm*—Max Fogiel

[57] ABSTRACT

An arrangement for cooling a synthetic gas, generated in a gasification reactor, by means of a quenching cooler. The cooler is positioned below the outlet from the reactor and comprises a refrigerated inner jacket (5) surrounded by a pressurization jacket (1) and accommodating a water sump (6). There is an intermediate section (3) between the inner jacket and the outlet from the gasification reactor that is shorter in diameter than the inner jacket and longer in diameter than the outlet from the reactor. Spray nozzles (15) extend into the inner jacket. One or more gas-outlet connections (8) extend through the inner jacket in a plane above the sump.

15 Claims, 5 Drawing Sheets

ARRANGEMENT FOR COOLING A SYNTHETIC GAS IN A QUENCHING COOLER

BACKGROUND OF THE INVENTION

The invention concerns an arrangement for cooling a synthetic gas, generated in a gasification reactor, by means of a quenching cooler positioned below the outlet from the reactor and comprising a refrigerated inner jacket surrounded by a pressurization jacket and accommodating a water sump, with an intermediate section between the inner jacket and the outlet from the gasification reactor that is shorter in diameter than the inner jacket and longer in diameter than the outlet from the reactor.

The inner jacket of a known quenching cooler (DE-C 2 940 933) is refrigerated by surface irrigation. It is difficult to apply a film of water to the surface of the inner jacket because the water tends to evaporate on the hot surface and break up the film. The gas generated in the gasification reactor is conveyed through a water sump in the known quenching cooler to cool it, saturate it with water, and free it of liquid slag and fly ash. The drawback to this type of quench cooling is that the water in the sump also picks up the halogen constituents in the gas and is heated by it. The water must accordingly, once the solids have been removed, be subjected to further processing and cooling. there is also a risk of the gas entraining droplets of water with fine particles of dust suspended in them as it leaves the sump in the known quenching cooler. These particles of dust can cake together on the wall of the cooler and in the downstream pipelines and clog them up.

The object of the invention is to cool the synthetic gas in an arrangement of the known type in such a way that the water sump will remain free of halogen constituents and deposits of dust will be prevented.

This object is attained in accordance with the invention in an arrangement of the type initially described in that spray nozzles extend into the inner jacket and in that one or more gas-outlet connections extend through the inner jacket in a plane above the water sump. Evaporation cooling can be carried out in a space without differential pressure and opening into the inner jacket between the inner jacket and the pressurization jacket. Other practical embodiments of the invention will be discussed in connection with the description.

The amount of steam in the synthetic gas is controlled in this arrangement by spraying water into the current of gas and not by conveying it through a water sump. The surface temperature of the refrigerated inner jacket will in normal operation more or less equal the boiling point that corresponds to the gasification operating pressure. Since the surface temperature is accordingly high above the saturation point that corresponds to the steam pressure of the synthetic gas, it will never drop below the dew point at the inner jacket. The spray nozzles and the intermediate section between the reactor outlet and the inner jacket will keep the reactor outlet warm, preventing the outlet from clogging up with solidifying liquid slag.

Several embodiments of the invention are illustrated in the drawing and will now be described in detail.

DESCRIPTION OF THE PREFERRED EMBODIMENTS

Figure 1:
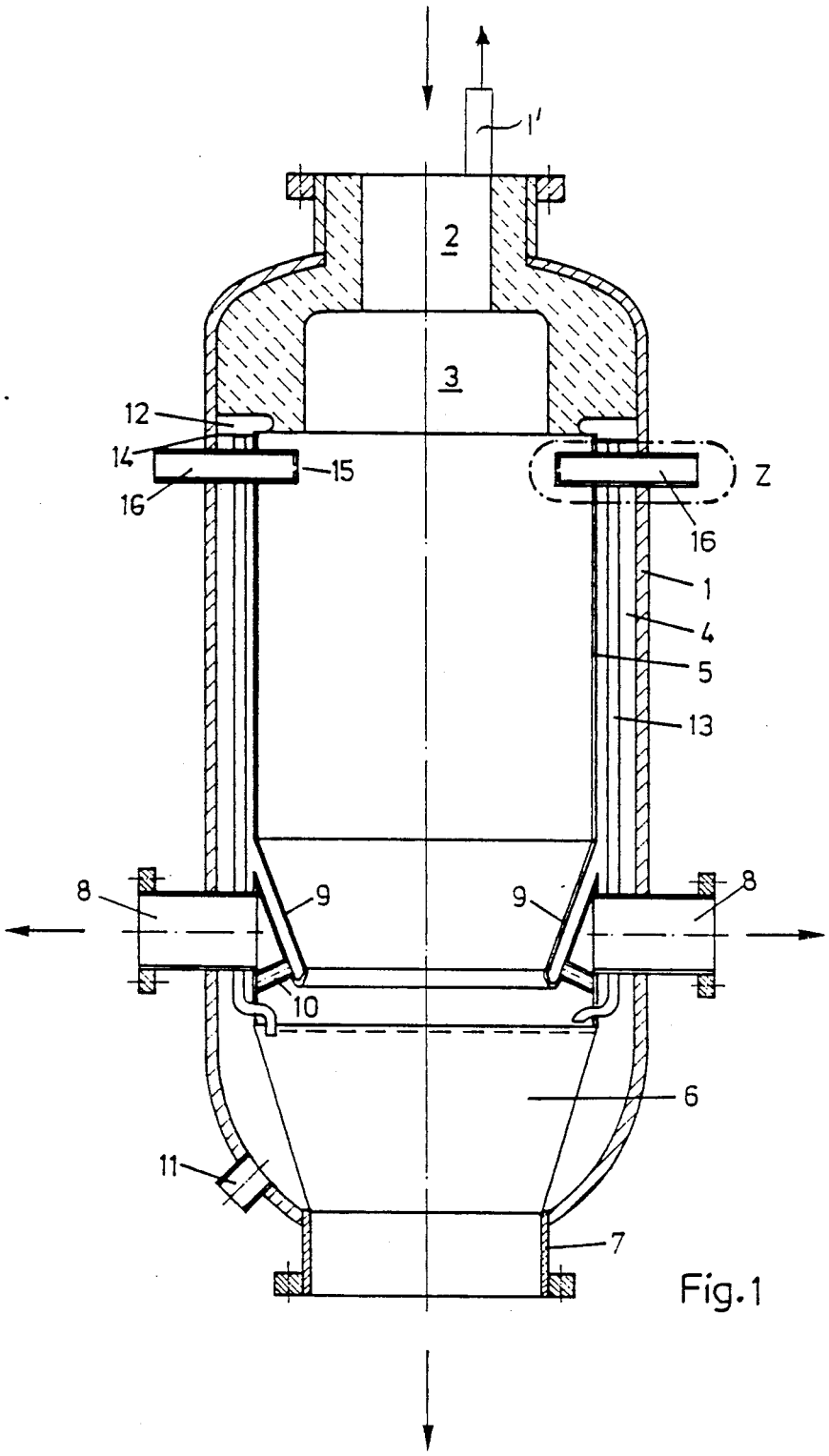
FIG. 1 is a longitudinal section through one embodiment of the invention.

Flanged onto the outlet 1 of an unillustrated pressurized gasification reactor is a quenching cooler that contains an outer pressurization jacket 1. The gas intake 2 into the quenching cooler is fireproof clad and its diameter is the same as that of the outlet from the reactor. Connected to gas intake 2 is an intermediate section 3 with a larger diameter. Intermediate section 3 is about half as high or as high as its diameter is long.

Gas intake 2 and intermediate section 3 are provided with fireproof heat insulation.

Below gas intake 2 and far enough away from pressurization jacket 1 to leave an annular space 4 between them is an inner jacket 5 that is tightly fastened to the pressurization jacket. The bottom of inner jacket 5 accommodates a water sump 6 that communicates with an outlet connection 7 at the bottom of pressurization jacket 1. The purpose of water sump 6 is to quench the liquid slag in the synthetic gas. The quenched slag is extracted along with the water in water sump 6 through outlet connection 7.

Above water sump 6 are one or more gas-outlet connections 8 that extend through inner jacket 5 and pressurization jacket 1. Upstream of the plane that accommodates gas-outlet connections 8, guides 9 slope down in the shape of a funnel out of the contour of inner jacket 5. The bottom edges of guides 9 project into inner jacket 5 and rest against it on pipes 10. The gas that flow through inner jacket 5 is accordingly deflected, improving the dust-precipitation situation, before emerging from gas-outlet connections 8.

The inner jacket 5 of the embodiment illustrated in FIG. 1 consists of a steel wall provided at the rear with an evaporation-cooling system that is unpressurized in relation to the processing pressure. The bottom of pressurization jacket 1 has for this purpose a connection 11 that opens into annular space 4. Processed feed water is supplied to annular space 4 through connection 11. At the top of annular space 4 is a chamber 12. Annular space 4 accommodates risers 13 that are welded into a perforated plate 14. The lower ends of risers 13 extend through inner jacket 5 below the plane of gas-outlet connections 8 and connect chamber 12 to the inside of the jacket, establishing a pressure equilibrium. The upper ends of risers 13 can either terminate above water sump 6 or immerse themselves in it. The volume of water inside annular space 4 is large enough to allow any residual or storage heat to be diverted through the open evaporation-exhaust system in the event of failure on the part of the quenching system until counteractive measures can be taken. The water that is constantly supplied during operation through connection 11 is conveyed along with any saturated steam into water sump 6 through risers 13.

Figure 4:
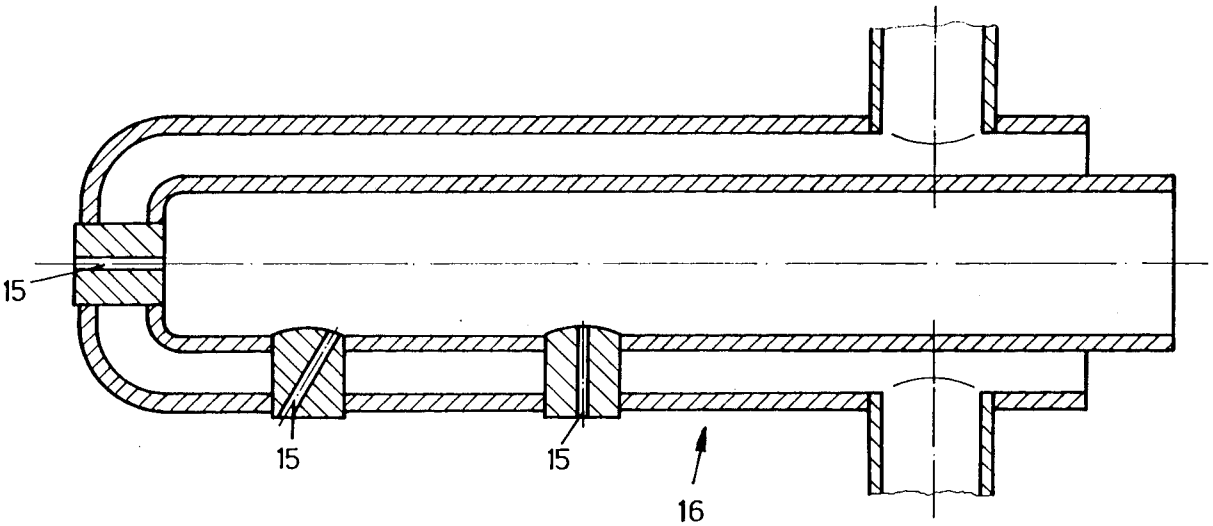
FIG. 4 illustrates the detail Z in FIG. 1.
Figure 5:
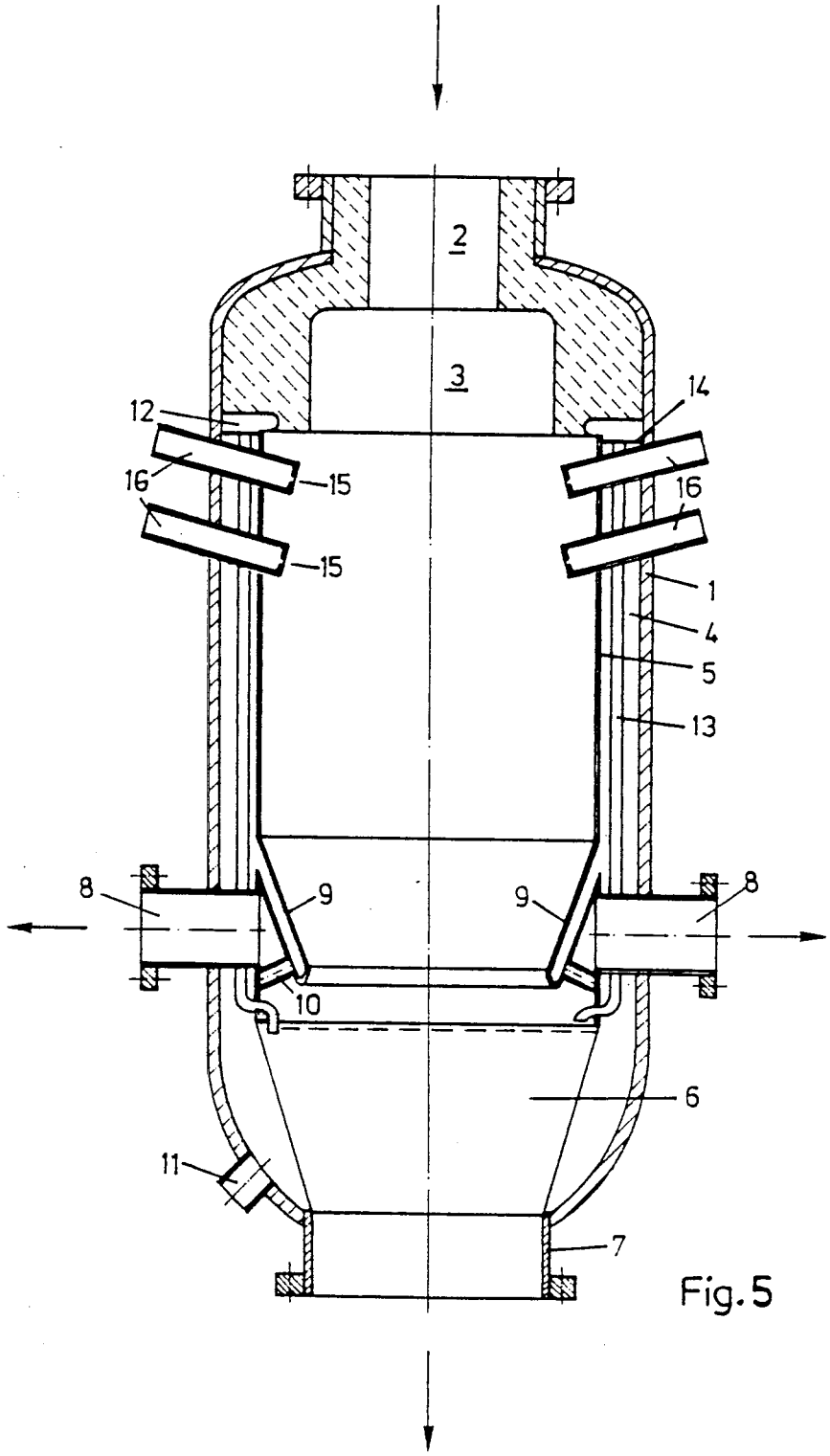
FIG. 5 shows slanted lances in different planes.

Spray nozzles 15 extend into inner jacket 5. The spray nozzles are accommodated in refrigerated lances 16 that extend through pressurization jacket 1 into inner jacket 5 and can be replaced. As will be evident from FIG. 4, spray nozzles 15 can either be oriented axially or radially in relation to lances 16 or can slope down. Lances 16 can be horizontal or slope down inside the quenching cooler. The first row of lances 16 is positioned directly below intermediate section 3. Other lances 16 can be positioned below the upper row see FIG. 5.

The forward edges of lances 16 are in the arc of a circle with a diameter that is longer than that of intermediate section 3. This measure protects lances 16 from ascending slag. Intermediate section 3 also prevents the refrigerated synthetic gas from coming into contact with the edge of gas intake 2 as the result of internal circulation and cooling it, keeping the ascending slag from freezing and clogging up gas intake 2.

The cooling of inner jacket 5 provides it with a surface temperature above the dew point of the synthetic gas. The amount of water released through spray nozzles 15 ensures that it will evaporate almost completely and that the synthetic gas will be cooled to approximately 300° to 600° C. when it leaves through gas-outlet connections 8. At this temperature the steam in the synthetic gas will still not condense out, and no significant amounts of halogens can enter the water in sump 6. It will not be necessary to heat the sump, considerably facilitating the handling of its contents when the quenched slag is removed. The refrigerated gas can if necessary be cooled even more in a radiation or convection cooler and supplied for further processing through a gas scrubber.

Figure 2:
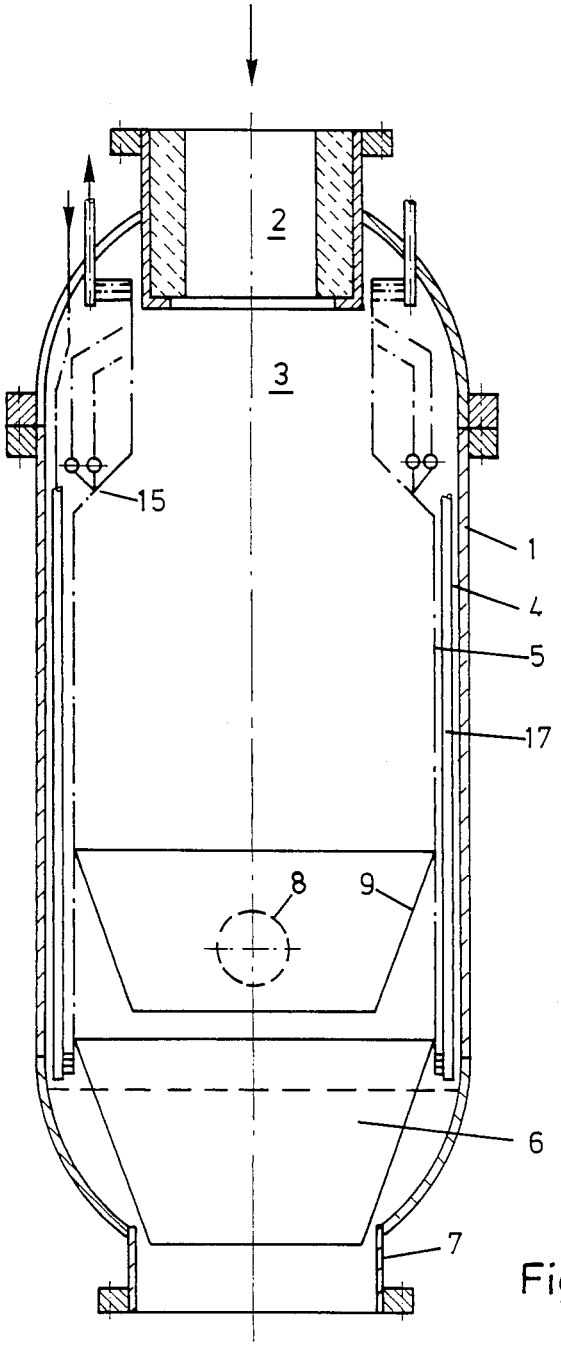
FIGS. 2 and 3 are longitudinal sections through other embodiments of the invention.

The inner jacket 5 in the embodiment illustrated in FIG. 2 is a gas-tight pipe wall that also constitutes intermediate section 3. The pipes spiral along the wall and are charged with water from pipes 17. The spray nozzles 15 in this system are integrated into the pipe wall of inner jacket 5.

Figure 3:
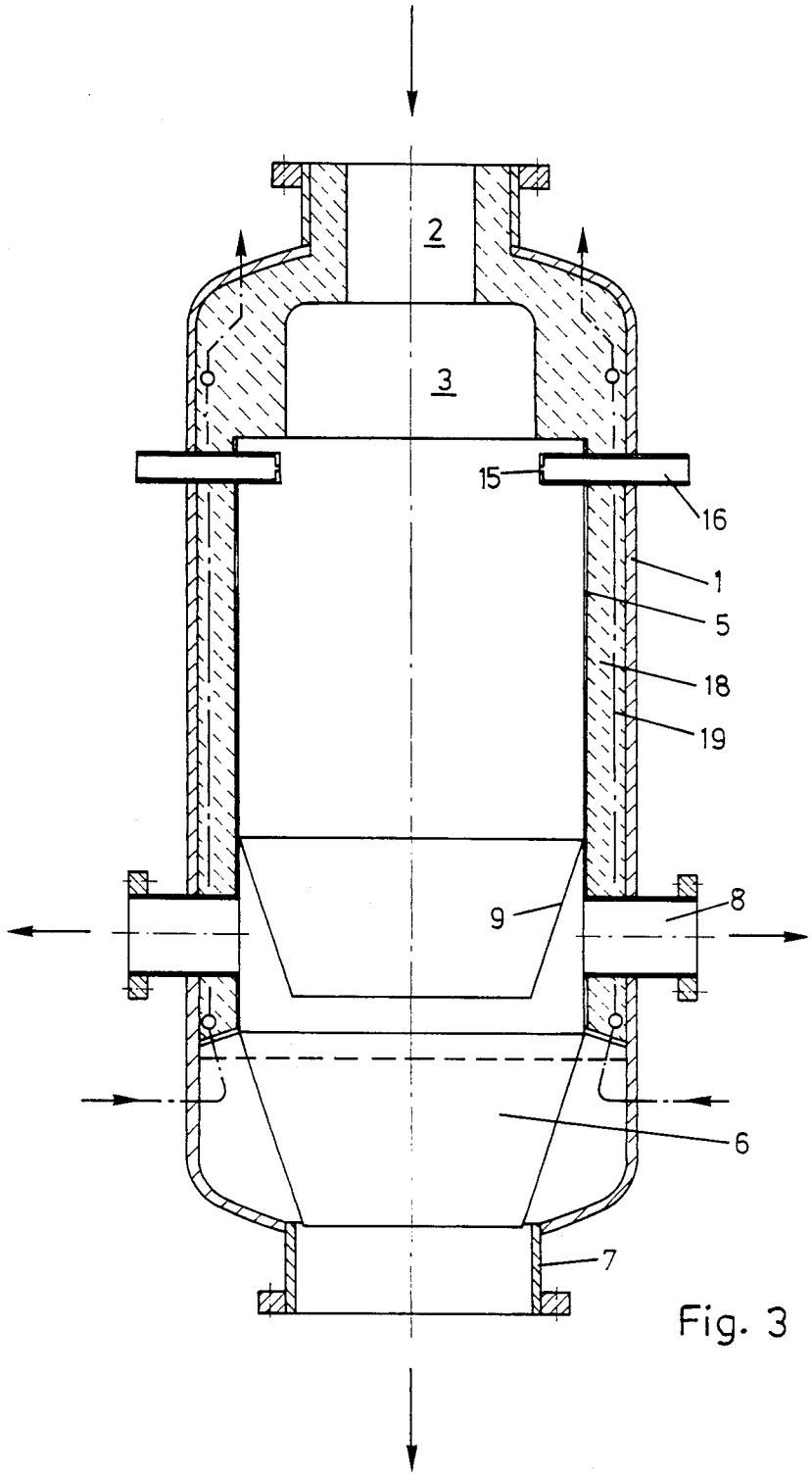

As will be evident from FIG. 3, the annular space between inner jacket 5 and pressurization jacket 1 can also be occupied by heat insulation 18 with refrigeration pipes 19 extending through it.

We claim:

1. An arrangement for cooling a synthetic gas, comprising: a gasification reactor for generating the gas in a gas stream; a quenching cooler positioned below an outlet from said reactor; said quenching cooler comprising a refrigerated inner jacket with a diameter and a bottom, a pressurization jacket surrounding said inner jacket, a water sump at the bottom of said inner jacket, an intermediate section between said inner jacket and said outlet from said reactor for holding warm said outlet from said reactor to prevent solidification of fluid ash flow-off, said outlet having a diameter, said intermediate section having a diameter shorter than the diameter of said inner jacket, said diameter of said intermediate section being longer than the diameter of said outlet from said reactor; spray nozzles extending into said inner jacket; at least one gas-outlet connection extending through said inner jacket in a plane above said sump; said gas being cooled directly by said quenching cooler through spraying water with said nozzles into the gas stream, said inner jacket being cooled for reducing the heat load of the inner jacket and said pressurization jacket, said intermediate section having a height for the formation of internal circulation of uncooled gas in said intermediate section, the circulated gas passing along the outlet edge of said outlet of said reactor.

2. An arrangement as defined in claim 1, including guides above said plane, said guides emerging from said inner jacket and having lower edges projecting into the interior of said inner jacket.

3. An arrangement as defined in claim 1, wherein said spray nozzles are mounted on lances which have forward edges distributed along an arc of a circle having a diameter longer than the diameter of said intermediate section.

4. An arrangement as defined in claim 1, wherein said spray nozzles are integrated into said inner jacket.

5. An arrangement as defined in claim 1, wherein said inner jacket comprises a gas-tight wall of pipes with water flowing through said pipes.

6. An arrangement as defined in claim 1, including replaceable refrigerated lances for mounting said spray nozzles.

7. An arrangement as defined in claim 6, wherein said lances slope downward.

8. An arrangement as defined in claim 6, wherein said lances are positioned one on top of another in a plurality of planes.

9. An arrangement as defined in claim 1, wherein said spray nozzles are positioned one on top of another in a plurality of planes.

10. An arrangement as defined in claim 1, including evaporation-cooling means having a pressure loss so that said water has an inlet pressure greater than the pressure within the inner jacket.

11. An arrangement as defined in claim 1, wherein said intermediate section has a height from substantially half to one time the diameter of said intermediate section.

12. An arrangement for cooling a synthetic gas, comprising: a gasification reactor for generating the gas in a gas stream; a quenching cooler positioned below an outlet from said reactor; said quenching cooler comprising a refrigerated inner jacket with a diameter and a bottom, a pressurization jacket surrounding said inner jacket, a water sump at the bottom of said inner jacket, an intermediate section between said inner jacket and said outlet from said reactor for holding warm said outlet from said reactor to prevent solidification of fluid ash flow-off, said outlet having a diameter, said intermediate section having a diameter shorter than the diameter of said inner jacket, said diameter of said intermediate section being longer than the diameter of said outlet from said reactor; spray nozzles extending into said inner jacket; at least one gas-outlet connection extending through said inner jacket in a plane above said sump; said gas being cooled directly by said quenching cooler through spraying water with said nozzles into the gas stream, said inner jacket being cooled for reducing the heat load of the inner jacket and said pressurization jacket, said intermediate section having a height for the formation of internal circulation of uncooled gas in said intermediate section, the circulated gas passing along the outlet edge of said outlet of said reactor; evaporation-cooling having a pressure loss so that said water has an inlet pressure greater than the pressure within the inner jacket; said evaporation-cooling means having an annular space filled with water between said pressurization jacket and said inner jacket; a chamber at the top of said annular space; risers received by said chamber and extending through said inner jacket below said gas-outlet connections, said risers connecting said chamber with the interior of said inner jacket.

13. An arrangement as defined in claim 12, wherein said risers terminate above said water sump.

14. An arrangement as defined in claim 12, wherein said risers are immersed in said water sump.

15. An arrangement for cooling a synthetic gas, comprising: a gasification reactor for generating the gas in a gas stream; a quenching cooler positioned below an outlet from said reactor; said quenching cooler comprising a refrigerated inner jacket with a diameter and a bottom, a pressurization jacket surrounding said inner jacket, a water sump at the bottom of said inner jacket, an intermediate section between said inner jacket and said outlet from said reactor for holding warm said outlet from said reactor to prevent solidification of fluid ash flow-off, said outlet having a diameter, said intermediate section having a diameter shorter than the diameter of said inner jacket, said diameter of said intermediate section being longer than the diameter of said outlet from said reactor; spray nozzles extending into said inner jacket; at least one gas-outlet connection extending through said inner jacket in a plane above said sump; said gas being cooled directly by said quenching cooler through spraying water with said nozzles into the gas stream, said inner jacket being cooled for reducing the heat load of the inner jacket and said pressurization jacket, said intermediate section having a height for the formation of internal circulation of uncooled gas in said intermediate section, the circulated gas passing along the outlet edge of said outlet of said reactor; an annular space between said inner jacket and said pressurization jacket; heat insulation mat filling said annular space; and refrigeration pipes extending through said heat insulation material.

* * * * *